US005678412A

United States Patent [19]

Byrne et al.

[11] Patent Number: 5,678,412

[45] Date of Patent: Oct. 21, 1997

[54] METHOD FOR CHANGING LUBRICANT TYPES IN REFRIGERATION OR AIR CONDITIONING MACHINERY USING LUBRICANT OVERCHARGE

[75] Inventors: John J. Byrne, Dublin; Michael E. Shows, Hilliard, both of Ohio; Robert Yost, Wilmington, Del.

[73] Assignee: Integral Sciences Incorporated, Columbus, Ohio

[21] Appl. No.: 685,245

[22] Filed: Jul. 23, 1996

[51] Int. Cl.[6] ..... F25B 43/02

[52] U.S. Cl. ..... 62/84; 62/303

[58] Field of Search ..... 62/84, 303, 468, 62/85

[56] References Cited

U.S. PATENT DOCUMENTS

| | | | |
|---|---|---|---|
| 3,592,017 | 7/1971 | Lipman et al. | 62/85 |
| 3,791,165 | 2/1974 | Honnold, Jr. et al. | 62/77 |
| 3,977,211 | 8/1976 | Bourne | 62/476 |
| 4,261,178 | 4/1981 | Cain | 62/149 |
| 4,267,705 | 5/1981 | Leonard et al. | 62/195 |
| 4,304,102 | 12/1981 | Gray | 62/195 |
| 4,363,222 | 12/1982 | Cain | 62/292 |
| 4,364,236 | 12/1982 | Lower et al. | 62/77 |
| 4,382,749 | 5/1983 | Teegarden et al. | 417/295 |
| 4,417,451 | 11/1983 | Spauschus | 62/129 |
| 4,437,322 | 3/1984 | Ertinger | 62/504 |
| 4,441,330 | 4/1984 | Lower et al. | 62/149 |
| 4,478,347 | 10/1984 | Manz et al. | 62/149 |
| 4,484,452 | 11/1984 | Houser, Jr. | 62/174 |
| 4,531,375 | 7/1985 | Zinsmeyer | 62/85 |
| 4,623,326 | 11/1986 | Fraser | 494/34 |
| 4,776,174 | 10/1988 | Rich et al. | 62/77 |
| 4,805,416 | 2/1989 | Manz et al. | 62/292 |
| 4,809,520 | 3/1989 | Manz et al. | 62/292 |
| 4,984,431 | 1/1991 | Mount et al. | 62/85 |
| 5,005,375 | 4/1991 | Manz et al. | 62/292 |
| 5,062,273 | 11/1991 | Lee et al. | 62/85 |
| 5,080,132 | 1/1992 | Manz et al. | 137/614 |
| 5,127,239 | 7/1992 | Manz et al. | 62/292 |
| 5,146,760 | 9/1992 | Paige | 62/149 |
| 5,146,761 | 9/1992 | Cavanaugh et al. | 62/149 |
| 5,157,933 | 10/1992 | Brendel | 62/196 |
| 5,170,640 | 12/1992 | Heitmann et al. | 62/470 |
| 5,172,562 | 12/1992 | Manz et al. | 62/149 |
| 5,182,918 | 2/1993 | Manz et al. | 62/149 |
| 5,184,944 | 2/1993 | Scarfone | 417/410 |
| 5,203,177 | 4/1993 | Manz et al. | 62/149 |
| 5,209,074 | 5/1993 | McConnell et al. | 62/85 |
| 5,209,077 | 5/1993 | Manz et al. | 62/149 |
| 5,243,828 | 9/1993 | Paige et al. | 62/125 |
| 5,247,804 | 9/1993 | Paige et al. | 62/77 |
| 5,317,906 | 6/1994 | Dolan et al. | 62/127 |
| 5,322,092 | 6/1994 | Howeth et al. | 141/3 |
| 5,325,675 | 7/1994 | Manz et al. | 62/77 |
| 5,345,774 | 9/1994 | Mount | 62/127 |
| 5,367,886 | 11/1994 | Manz et al. | 62/195 |
| 5,377,496 | 1/1995 | Otto et al. | 62/129 |
| 5,388,416 | 2/1995 | Manz et al. | 62/85 |
| 5,415,003 | 5/1995 | Bertva et al. | 62/85 |
| 5,437,162 | 8/1995 | Eden | 62/84 |
| 5,445,496 | 8/1995 | Brasz | 415/208 |
| 5,456,841 | 10/1995 | Lee | 210/640 |
| 5,458,798 | 10/1995 | Lunger et al. | 252/67 |
| 5,469,714 | 11/1995 | Manz et al. | 62/125 |
| 5,600,959 | 2/1997 | Gay | 62/84 |

*Primary Examiner*—John M. Sollecito
*Attorney, Agent, or Firm*—Standley & Gilcrest

[57] ABSTRACT

The present invention includes a method for changing lubricant types in closed cooling systems such as refrigeration, air-conditioning machinery, and the like. The present invention is also applicable to heat pumps. The method of the present invention may be used on such systems that comprise one or more compressors, one or more evaporators, and one or more condensers. The method of the present invention allows the original compressor lubricant to be drained and replaced with a new lubricant; typically a lubricant of a different type than the original lubricant. Through use of the method of the present invention, all accessible points in the system (i.e., the compressor, the high side oil separator, if so equipped, and the accumulator, if so equipped, etc.) may be drained of the original lubricant and recharged with a new lubricant. After this is done, the original lubricant may still remain in the evaporator, condenser, and/or associated fluid lines.

11 Claims, 2 Drawing Sheets

Mineral Oil Removal From a Small Refrigeration System

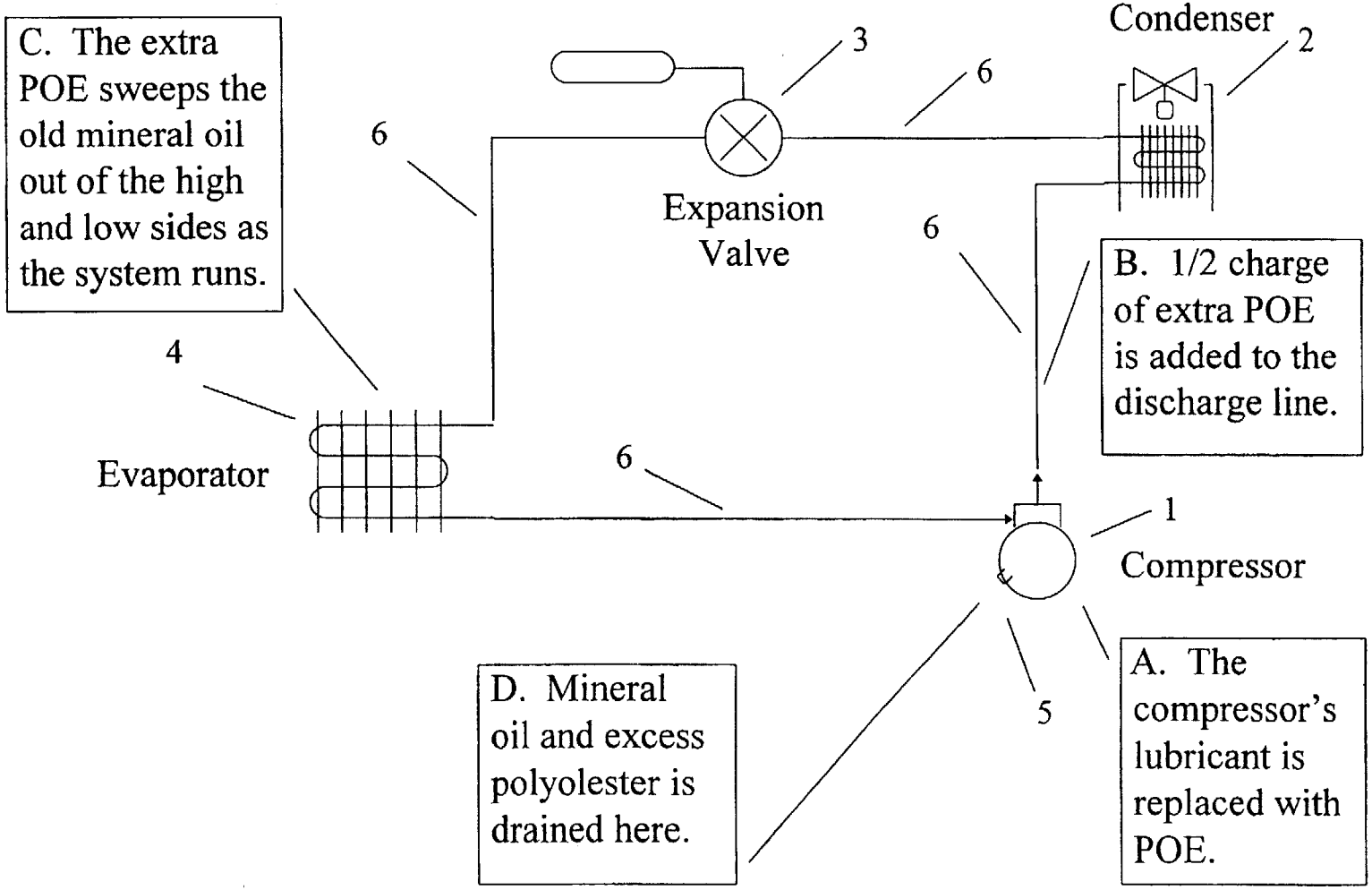
Figure 1: Mineral Oil Removal From a Small Refrigeration System

Figure 2: Mineral Oil Removal From Large Refrigeration Systems
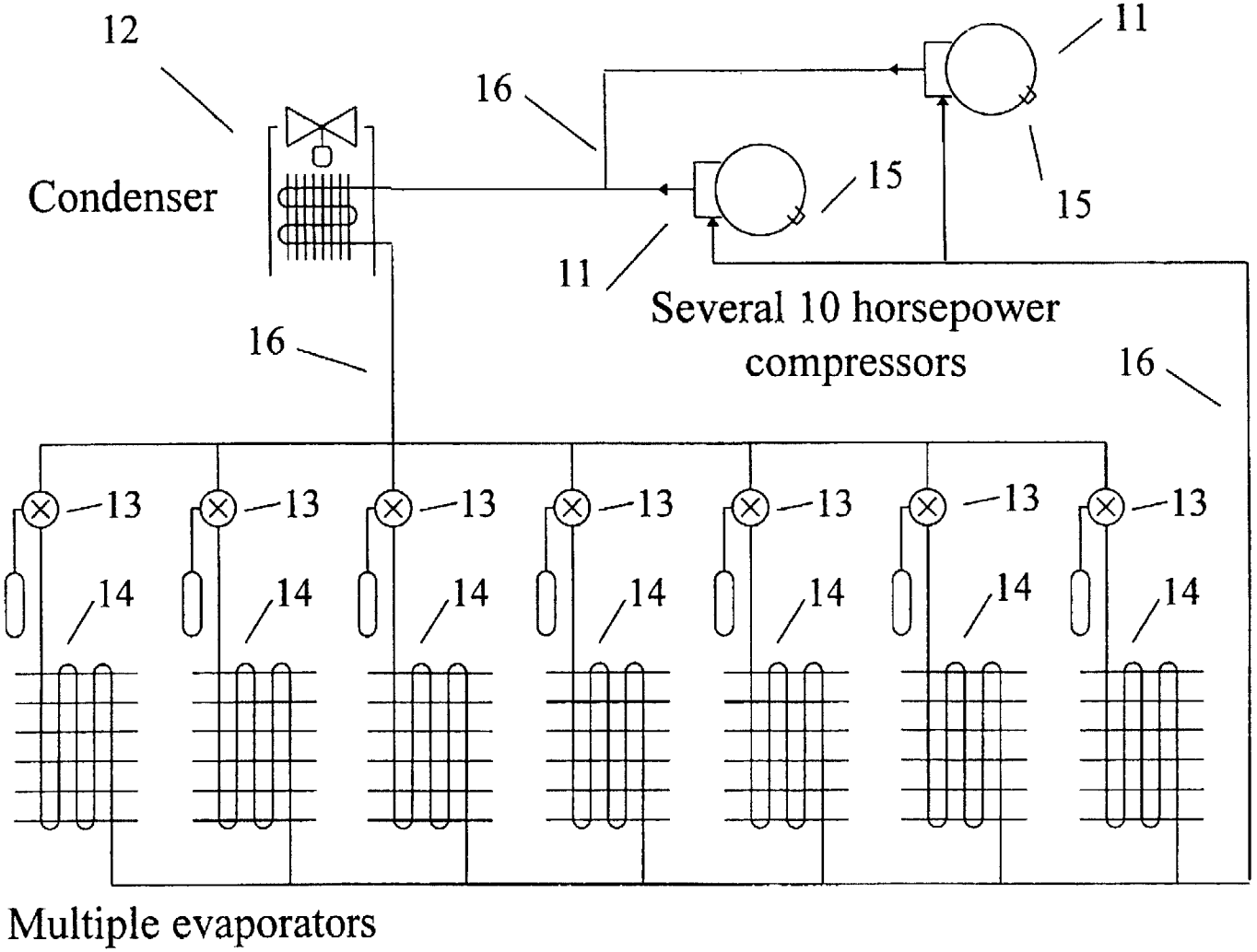

METHOD FOR CHANGING LUBRICANT TYPES IN REFRIGERATION OR AIR CONDITIONING MACHINERY USING LUBRICANT OVERCHARGE

TECHNICAL FIELD

This invention is an efficient process for removing lubricant from evaporators, condensers, and associated tubing in refrigeration and air-conditioning systems, and may be used in instances where a new lubricant of a different type is to be used.

BACKGROUND

The process of retrofitting air-conditioning and refrigeration equipment to operate with CFC substitutes such as HFC-134a generally requires replacement of the system's lubricant with a new lubricant which is miscible with the new refrigerant. A common example is the removal of mineral oil from CFC-12 systems which are being converted to use HFC-134a and polyolester (POE) lubricant.

The replacement of one lubricant with another is time consuming because the old lubricant is located not only in compressors but also in points which cannot be drained, such as evaporators, condensers, and associated tubing. Although much of the compressor lubricant can often be drained, as much of half of a system's lubricant is located away from the compressor where the lubricant is not readily accessible.

The most popular method of changing the type of lubricant in a system has been to drain and refill the compressor repeatedly with the new lubricant type. Between changes, the system is operated for an extended period, typically 24 hours or longer, to distribute the new lubricant type into the evaporator and condenser while allowing the old lubricant type to migrate from the evaporator and condenser to the compressor where it can be drained. Often 95 to 99% of the old lubricant must be removed, and this usually requires at least three lubricant changes to effect the appropriate amount of system flushing.

There are several disadvantages to this popular approach. The process is very expensive because the process normally is carried out over a long period of time and the operator must make separate site visits for each of the successive compressor lubricant changes. This process also requires a relatively large quantity of the new lubricant to be used in the several lubricant changes.

A second method is used for mobile air-conditioning equipment. In this method, the evaporator, condenser and lines are disconnected from the system and flushed with a liquid solvent. One such solvent is a terpene hydrocarbon, and its use in this application is the subject of U.S. Pat. No. 5,174,906. The flushing solvent is ejected by flushing the evaporator, condenser and lines with compressed air.

This approach is unsuitable for stationary refrigeration and air-conditioning equipment for several reasons. One disadvantage is that the flushing solvent is extremely difficult to remove. For small mobile systems such as automobile air-conditioners, approximately 2,000 cubic feet of air is required to purge the evaporator, condenser and lines. These must be purged as separate, single-path components; i.e., the evaporator and condenser must be disconnected from each other. Because most stationary systems involve hundreds (and sometimes thousands) of feet of tubing and may have multiple evaporators and condensers, there is no practical way of using purge air to remove the solvent from the systems. Furthermore, these systems contain large low points where the solvent can pool and remain indefinitely.

Another problem with this second method is that the flushing solvent is expensive, and the large size of many stationary systems would make many solvents cost-prohibitive.

A third problem with this second method is that many flushing solvents are not chemically compatible with system materials. Because stationary refrigeration systems often have operating lifetimes in excess of 250,000 hours, they are subject to more stringent standards than their mobile air-conditioning counterparts, which are usually retired well before 3,000 hours of actual service. On many stationary systems, introduction of the flushing solvent used in this procedure would invalidate the manufacturer's warranty.

A fourth disadvantage is that care must be used in handling flushing solvents, which are often toxic. Exposure to vapor from one commonly used terpene hydrocarbon flushing solvent can produce headaches, dizziness, nausea, vomiting and malaise. Minute amounts aspirated into the lungs can produce severe lung injury, chemical pneumonitis, pulmonary edema or death.

A fifth disadvantage is that the air purge process can introduce moisture, non-condensables and particulate matter into the system. All of these contaminants are harmful to air-conditioning and refrigeration systems and may effect system failure.

Several other potential solvents have been advanced as flushing materials in both stationary and mobile equipment. Such solvents include CFC-11, CFC-12, trichloroethylene, perchloroethylene, CFC-113, and hexane. All these solvents are problematic either due to the their ozone depletion potential, flammability, toxicity, incompatibility with system materials, or their difficulty of removal from the system.

A third method for removing lubricant from refrigeration and air-conditioning systems has been researched; this method is comparatively new and is not in widespread use. The method involves the use of a low side oil separator added to the compression suction line. The system is run for an extended period, typically 24 hours, to allow the old lubricant to slowly migrate from the evaporator, condenser and associated tubing to the low side oil separator. This method is described in *Investigation of Flushing and Clean-Out Methods for Refrigeration Equipment to Ensure System Compatibility*, Apr. 19, 1994.

One disadvantage of this third method is that the time required for the lubricant to migrate from the evaporator, condenser and associated lines is too long. A technician must remain with the system overnight to drain the low side oil separator and replace lubricant which is lost from the compressor to the system. In the absence of this technician, the compressor would eventually run out of lubricant and fail. Another drawback of this method is that large amounts of the new lubricant type may be required. In such instances, there would be excessive lubricant costs in addition to excessive quantities of waste lubricant requiring disposal.

Accordingly, it is desirable to be able to develop a method which can remove lubricant in a single site visit, and which can flush refrigeration or air-conditioning systems by using a lesser amount of the new lubricant to be installed.

It is also desirable to use a method which does not introduce any foreign chemical compounds into the system, even temporarily. It is also desirable to use a method which does not require a solvent removal step.

It is also advantageous to use a method which has no substantial cost associated with additional fluids, and which does not use additional materials which may give rise to chemical compatibility concerns. It is also desirable to be able to use a method which does not require the use of additional hazardous substances at the operation site. It is also most advantageous to be able to use a lubricant replacement method which does not require the use of a purging air stream which can introduce moisture, non-condensables or particulate matter into the system.

Finally, it is beneficial to be able to use a lubricant replacement method which requires much less time than the prior art methods discussed above. Most preferably, it is desirable to be able to use a method which can remove essentially all of the old lubricant from the evaporator(s), condenser(s), and associated tubing in approximately one hour.

In view of the present disclosure or through practice of the present invention, other advantages and a solution to attendant problems may become apparent.

SUMMARY OF THE INVENTION

The present invention includes a method for changing lubricant types in closed cooling systems such as refrigeration, air-conditioning machinery, and the like. The present invention is also applicable to heat pumps. The method of the present invention may be used on such systems that comprise one or more compressors, one or more evaporators, and one or more condensers.

The method of the present invention allows the original compressor lubricant to be drained and replaced with a new lubricant; typically a lubricant of a different type than the original lubricant. Through use of the method of the present invention, all accessible points in the system (i.e., the compressor, the high side oil separator, if so equipped, and the accumulator, if so equipped, etc.) may be drained of the original lubricant and recharged with a new lubricant. After this is done, the original lubricant may still remain in the evaporator, condenser, and/or associated fluid lines.

In broadest terms, the method of the present invention is a method of changing the lubricant in a heat transfer apparatus that contains an original lubricant. The heat transfer apparatus may be any type of closed-system cooling apparatus, such as refrigeration and air-conditioning devices, or a heat pump. The heat transfer apparatus with which the method of the present invention may be used generally will include at least one compressor, at least one evaporator and at least one condenser. The compressor(s), evaporator(s) and condenser(s) are typically connected by fluid lines containing an original lubricant and the apparatus generally will operate at a base operational lubricant circulation rate. The evaporator(s) define a total evaporator volume.

Generally, the method of the present invention comprises the steps of: (1) introducing a quantity of a flushing material to the fluid lines, the quantity of flushing material being determined to increase the lubricant circulation rate of the heat transfer apparatus above the base lubricant circulation rate; (2) operating the heat transfer apparatus so as to cause the original lubricant to migrate within the heat transfer apparatus to the compresser(s) prior to the original lubricant completing one cycle within the heat transfer apparatus; and (3) removing the original lubricant from the compresser(s).

As used herein, it will be understood that reference to a cycle within or through the heat transfer apparatus shall be understood as referring to the complete path taken by refrigerant and lubricant through a heat transfer apparatus. This will typically refer to the path taken by the refrigerant and lubricant from one point in the closed refrigerant system through the system and returning to that point. In the present invention, the heat transfer apparatus is operated so as to cause the original lubricant to migrate within the heat transfer apparatus to the lubricant removal device and prior to the original lubricant completing one cycle within the heat transfer apparatus. Normally and preferably, this will involve the completion or substantial completion of such a cycle by the flushing material, preferably from a point on the high side of the system just beyond the compressor(s), to a point on the low side of the system just upstream of the compressor(s).

The quantity of flushing material should be determined to increase the lubricant circulation rate of the heat transfer apparatus above the base lubricant circulation rate. As used herein, the term "base lubricant circulation rate" shall be understood as meaning the normal operational circulation rate of the lubricant within the heat transfer apparatus. With respect to the volume of the flushing material used in the method of the present invention, the volume used will typically and preferably be much less than the total evaporator volume, and typically less than one-tenth of the total evaporator volume. Another measurement used to determine a sufficient amount of flushing material is to use an amount that is about 50% of the amount of lubricant contained in the compressor.

With respect to the increase in the circulation rate brought about by the addition of the flushing material, it is preferred that the lubricant circulation rate is increased in step 2 to a rate of at least 5 times the base lubricant circulation rate, and most preferably to a rate of at least 10 times the base lubricant circulation rate.

Most preferably, the flushing material is a replacement lubricant of a type different than the original lubricant. Such replacement lubricants may include those selected from the group consisting of alkylbenzenes, polyalkylene glycols, and polyolesters, such as in cases where the original lubricant is mineral oil. It is preferred that the flushing material be selected such that the original lubricant is miscible with the flushing material.

The heat transfer apparatus may be any cooling or heating device such as those mentioned herein, including those selected from the group consisting of refrigeration systems, air-conditioning systems, and heat pumps.

Typically, the original lubricant in many types of heat transfer apparatus to which the method of the present invention may be applied is mineral oil.

It may be the case that the heat transfer apparatus has more than one of any component selected from the group consisting of compressors, evaporators, and condensers.

In one embodiment of the method of the present invention, an overcharge of the new lubricant is added to the high side of the heat transfer apparatus; and in a preferred embodiment, the additional lubricant is pumped into the compressor discharge line. The overcharge is typically of sufficient magnitude that lubricant migration rates in the heat transfer apparatus are significantly increased.

Subsequently, the heat transfer apparatus is started with the excess lubricant in the high side. The refrigerant flow quickly circulates the excess lubricant through the condenser (s), evaporator(s), and associated fluid lines. Most of this lubricant returns to and becomes trapped in the lubricant removal device. As the new lubricant passes through the condenser(s), evaporator(s) and associated fluid lines, it mixes with and carries the original lubricant from the condenser(s), evaporator(s) and associated fluid lines to the lubricant removal device.

The compressor can either be drained of the additional lubricant by the operator as the heat transfer apparatus operates, or it can be drained after the apparatus is shut off. In a short amount of time, nearly all of the original lubricant type can be removed from the system by this process. The compressor lubricant (along with lubricant from other readily drainable places) is then changed a second time to remove any small amount of the original lubricant which may still remain. It is preferred that the compressor be provided with an access port to allow the lubricant to be taken out conveniently.

There are many advantages to the present invention. The method of the present invention allows the operator to remove old lubricant in a single visit, and requires less new lubricant than methods of the prior art.

The method of the present invention also has the advantage of not introducing any foreign chemical compounds into the heat transfer apparatus, even temporarily.

Accordingly, there is no need for further solvent removal from the heat transfer apparatus. There are no costs for additional fluids except for a modest amount of additional new lubricant. The fact that no other substances are introduced eliminates further chemical compatibility concerns. Likewise, no new hazardous substances are brought to the site through the practice of the present invention. The method of the present invention also requires no air purging that would otherwise introduce moisture, non-condensables or particulate matter into the heat transfer apparatus.

The method of the present invention also allows the operator to force old lubricant to migrate from the heat transfer apparatus much more quickly. In applying the method of the present invention, a heat transfer apparatus can be cleared of all of the old lubricant within a single hour of system operation, and removal extends to the evaporator (s), condenser(s) and associated fluid lines.

The present invention also eliminates the time and expense associated with providing, installing, and removing a temporary oil separator such as used in the prior art.

The method of the present invention has worldwide application, particularly in developed countries. One of the most common and important uses of the present invention may be the removal of mineral oil from refrigeration and air-conditioning systems which are being retrofitted from CFC-12 to HFC-134a. Mineral oil is not an acceptable lubricant for HFC-134a applications, which typically use a polyolester-(POE-) or polyalkylene glycol-(PAG-) based lubricant.

The manufacture of CFC-12 in the United States was banned effective Jan. 1, 1996 under Section 608 of the Clean Air Act. This refrigerant is still in use nationwide. A typical use where replacement of CFC-12 with HFC-134a is desirable is in supermarket refrigeration, where unavailability of CFC-12 would otherwise prevent the service and maintenance of such equipment. Accordingly, the present invention is particularly important because it can substantially lower the cost of retrofitting systems to HFC-134a. It is also particularly important because the reduced cost could accelerate the phase out of substances such as CFC-12 that damage the ozone layer of the atmosphere.

BRIEF DESCRIPTION OF THE DRAWINGS

FIG. 1 is a schematic of a refrigeration system whose lubricant may be changed through use of one embodiment of the present invention; and FIG. 2 is a schematic of a refrigeration system whose lubricant may be changed through use of another embodiment of the present invention.

DETAILED DESCRIPTION OF THE PREFERRED EMBODIMENTS

In accordance with the foregoing summary of the invention, the following presents a preferred embodiment of the present invention.

EXAMPLE 1

Small System Retrofit

FIG. 1 shows a schematic of a small R-12 refrigeration system upon which the method of the present invention might be practiced. The system shown in FIG. 1 includes a compressor 1, condenser 2, expansion valve 3, evaporator 4 and compressor access port 5. The elements of the system are interconnected as shown by fluid lines 6.

Oil is distributed throughout the refrigeration system, much of which is concentrated at the compressor. By changing the compressor lubricant, one usually can remove half or more of the mineral oil immediately, and this is preferred. The use of an oil suction pump can be very helpful during this step, and is also preferred. Similarly, the original lubricant should be changed in any discharge oil separator if the system is provided with one.

Although a small amount of mineral oil may remain in the compressor and discharge oil separator after they are drained, most of this remaining mineral oil can be removed by means of a second compressor oil change at the end of the procedure.

FIG. 1 shows compressor access port 5. This access port can be drained to a point outside of the system. When the system is started, oil circulation begins immediately, and mineral oil begins to leave the evaporator and condenser and become trapped in the compressor.

In the method of the present invention the problem of the relatively long time needed for system flushing is addressed by adding extra polyolester lubricant to the high side before the system is turned on. In the described embodiment, a charge of approximately one-half compressor volume of replacement lubricant is put into the refrigeration system. This overcharge of replacement lubricant moves through the condenser and evaporator quickly, usually arriving at the low side separator within the first hour of operation. It has been found that this additional overcharge of replacement lubricant removes most of the remaining mineral oil.

Preferably, once the original mineral oil lubricant has been recovered from the system's high and low side, the compressor lubricant is changed a second time. This may aid in removing residual mineral oil which may have persisted in the compressor after the first change. If the system has a discharge oil separator, it is preferred that the lubricant be changed again as well.

The method of Example 1 was performed in a laboratory on a 3 ton refrigeration system. The system was charged and operated with CFC-12 and mineral oil until the compressor oil level was constant for a 24 hour period. Following this, one-half compressor charge of POE was introduced into the high side liquid line. The system was operated for 20 minutes to allow the POE to migrate to the compressor. The system was then pumped down, and the compressor lubricant was replaced with polyolester.

An additional one-half compressor charge of POE was added to the high side liquid line. The system was then restarted, and the system was operated for a short time to allow this second overcharge of POE to migrate to the compressor. In order to maintain the compressor lubricant at a correct level, lubricant was drained periodically from the compressor as necessary. The compressor was equipped with a sight glass to monitor the lubricant level; this is preferred.

This was the very first test of this method, and the entire procedure took only two hours. The system lubricant's mineral oil content was reduced by this procedure from 100% to 8.3%. The mineral oil content might have been reduced further had the compressor lubricant been replaced with polyolester at the beginning of the procedure; however, this was not done in this early test.

Unlike some of the flushing methods traditionally used for mobile air-conditioning equipment, this method does not require bypassing or forcing open any expansion devices in the system. This advantage arises because the amount of additional oil which must pass through these devices is relatively small.

EXAMPLE 2

Large System Retrofit

FIG. 2 shows a schematic of a large low-temperature R-502 refrigeration system, such as might be used in a supermarket or other large building, and wherein the charge of replacement lubricant (e.g., a polyolester) would have several paths to follow, such as through more than one evaporator.

The system depicted in FIG. 2 has five 10-horsepower compressors 11 and at least fifteen evaporators 14 with accompanying expansion valves 13. Also depicted are the condenser 12 and compressor access ports 15. The system components are interconnected by fluid lines 16. Although it's not shown, the system also has a high side oil separator which can help maintain the compressor lubricant at a safe level during the test. This is a preferred feature of the present invention.

The system's high and low sides were flushed twice using this procedure. For each flush, a polyolester lubricant overchange of approximately one-half of the total compressor lubricant capacity was pumped into the high side of the system. The system was then operated for approximately one hour to allow this excess POE to migrate through the system and return to the compressors, where the excess POE was drained along with mineral oil. After the two flushes, the lubricant in the compressors and discharge separator was changed from mineral oil to polyolester without the use of an oil suction pump.

After finishing the same replacement procedure, the system was operated for at least 300 hours before sampling and analyzing the compressor lubricant by liquid chromatography. Using this method, the system's mineral oil content was reduced from 100% to 13.1% in a single site visit. The reduction would have been greater had an oil suction pump been used as preferred.

In view of the foregoing disclosure, it will be within the ability of those skilled in the art to make modifications to the present invention, such as through the substitution of equivalent steps, so as to be able to practice the invention without departing from its scope as reflected in the appended claims.

What is claimed is:

1. A method of changing the lubricant in a heat transfer apparatus containing an original lubricant and comprising at least one compressor, at least one evaporator and at least one condenser, said at least one compressor, at least one evaporator and at least one condenser being connected by fluid lines, and said heat transfer apparatus having a base operational lubricant circulation rate, said method comprising the steps:

a) introducing a quantity of a flushing material to said fluid lines, said quantity of said flushing material being determined to increase the lubricant circulation rate of said heat transfer apparatus above said base lubricant circulation rate;

b) operating said heat transfer apparatus so as to cause said original lubricant to migrate within said heat transfer apparatus to said at least one compressor such that said original lubricant is collected in said at least one compressor before completing a cycle within said heat transfer apparatus; and c) removing said original lubricant from said at least one compressor.

2. A method according to claim 1 wherein said lubricant circulation rate is increased in step a to a rate of at least 5 times said base lubricant circulation rate.

3. A method according to claim 1 wherein said at least one evaporator defines a total evaporator volume, and said quantity of said flushing material is less in volume than said total evaporator volume.

4. A method according to claim 3 wherein said quantity of said flushing material is less in volume than one fifth said total evaporator volume.

5. A method according to claim 1 wherein the portion of said original lubricant which is contained within said at least one compressor defines a total compressor lubricant volume, said quantity of said flushing material is about 50% of the volume of said total compressor lubricant volume.

6. A method according to claim 1 wherein said flushing material is a replacement lubricant of a type different than said original lubricant.

7. A method according to claim 6 wherein said replacement lubricant is selected from the group consisting of alkylbenzenes, polyalkylene glycols, and polyolesters.

8. A method according to claim 1 wherein said heat transfer apparatus is selected from the group consisting of refrigeration systems, air-conditioning systems, and heat pumps.

9. A method according to claim 1 wherein said original lubricant is mineral oil.

10. A method according to claim 1 wherein said heat transfer apparatus has more than one of any component selected from the group consisting of compressors, evaporators, and condensers.

11. A method according to claim 1 wherein at least one of said at least one compressor comprises an access port through which said original lubricant is removed.

* * * * *